US010728645B2

(12) United States Patent
Briggs et al.

(10) Patent No.: US 10,728,645 B2
(45) Date of Patent: Jul. 28, 2020

(54) EARPIECE WITH STABILIZING FEATURES AND RELATED TECHNOLOGY

(71) Applicant: New Audio LLC, New York, NY (US)

(72) Inventors: Drew Stone Briggs, Brooklyn, NY (US); Nicholas Slaney, Jersey City, NJ (US); Thomas C. Wilson, Brooklyn, NY (US); Marten Wallby, Malmo (SE)

(73) Assignee: New Audio LLC, New York, NY (US)

( * ) Notice: Subject to any disclaimer, the term of this patent is extended or adjusted under 35 U.S.C. 154(b) by 0 days.

(21) Appl. No.: 15/853,395

(22) Filed: Dec. 22, 2017

(65) Prior Publication Data

US 2019/0200112 A1 Jun. 27, 2019

(51) Int. Cl.
*H04R 1/10* (2006.01)

(52) U.S. Cl.
CPC ..... *H04R 1/1016* (2013.01); *H04R 1/105* (2013.01); *H04R 1/1066* (2013.01)

(58) Field of Classification Search
CPC .... H04R 1/1016; H04R 1/105; H04R 1/1058; H04R 25/658; H04R 25/652; H04R 2460/17; H04R 2225/023
USPC ..... 381/380
See application file for complete search history.

(56) References Cited

U.S. PATENT DOCUMENTS 7,986,803 B1 * 7/2011 DeKalb ..... H04R 1/1066 381/328
8,929,582 B2 * 1/2015 Silvestri ..... H04R 1/1016 381/380
9,380,370 B2 * 6/2016 Lowry ..... H04R 1/1016
D780,155 S 2/2017 Levine
9,736,569 B2 * 8/2017 Kelly ..... H04R 25/652
D820,810 S 6/2018 Levine
2003/0174853 A1 * 9/2003 Howes ..... H04R 1/083 381/370
2008/0144877 A1 * 6/2008 Ham ..... H04R 1/105 381/379

(Continued)

FOREIGN PATENT DOCUMENTS

JP 2017147533 A 8/2017

OTHER PUBLICATIONS

PCT International Search Report and Written Opinion dated Apr. 17, 2019 from the Korean International Search Authority, 10 pages.

(Continued)

*Primary Examiner* — Oyesola C Ojo
(74) *Attorney, Agent, or Firm* — Holzer Patel Drennan

(57) ABSTRACT

An earpiece in accordance with at least some embodiments of the present technology includes a housing and a speaker within the housing. The earpiece can also include an earbud and a protrusion carried by the housing. The earbud can extend from the housing toward a canal of a user's ear when the earpiece is mounted to the user's ear. The protrusion can be at least partially received within a recess at least partially defined by a cymba concha of the user's ear and by an anterior ridge of an antihelix of the user's ear when the earpiece is mounted to the user's ear. The protrusion can include resilient members and intervening slots. The individual resilient members can be configured to preferentially bend relative to the housing in a direction parallel to an adjacent length of the anterior ridge when the earpiece is mounted to the user's ear.

14 Claims, 5 Drawing Sheets

(56) References Cited

U.S. PATENT DOCUMENTS

| | | | | |
|---|---|---|---|---|
| 2011/0255729 | A1* | 10/2011 | Tan | H04R 1/105 381/380 |
| 2014/0286515 | A1* | 9/2014 | Bone | H04R 1/1016 381/328 |
| 2015/0358711 | A1* | 12/2015 | Tan | H04R 1/105 381/380 |
| 2015/0385711 | | 12/2015 | Tan et al. | |
| 2016/0249133 | A1* | 8/2016 | Sorensen | H04R 1/105 |
| 2016/0286300 | A1* | 9/2016 | Hussein | A61F 11/08 |
| 2017/0127198 | A1* | 5/2017 | Hagen | H04R 1/1008 |
| 2017/0339479 | A1 | 11/2017 | Levine | |
| 2018/0035196 | A1* | 2/2018 | Yeung | H04R 1/1025 |
| 2018/0213315 | A1* | 7/2018 | Kirkpatrick | A61F 11/12 |
| 2018/0332379 | A1* | 11/2018 | McGarry | H04R 1/1016 |

OTHER PUBLICATIONS

Master & Dynamic MW07 True Wireless Earphones, posted Sep. 19, 2018 [online], retrieved Dec. 6, 2018, retrieved from Internet, <https://www.amazon.com/Master-Dynamic-Earphones-Connectivity-Tortoiseshell/dp/B07H8S4N36>.

MW07_SKU_TS_15, posted Sep. 11, 2018 0:04 [online], retrieved Dec. 6, 2018, retrieved from internet, <https://www.youtube.com/watch?v=UKkBh3XIIQk&feature=youtu.be>.

True Wireless Earphones, posted © 2018 [online], retrieved Dec. 6, 2018, retrieved from internet, <https://www.masterdynamic.com/products/mw07-true-wireless-earphones>.

* cited by examiner

EARPIECE WITH STABILIZING FEATURES AND RELATED TECHNOLOGY

TECHNICAL FIELD

The present technology is related to personal audio systems that include at least one earpiece.

BACKGROUND

Many personal audio systems include an earpiece configured to be worn at or near a user's ear. The earpiece includes a speaker that converts an audio signal into sound. Because the sound is generated in close proximity to the user's eardrum, the sound is fully audible to the user while still being inaudible or minimally audible to others around the user. For this reason, these personal audio systems are often well-suited for use in public settings. The earpiece of a conventional personal audio system may be supported by a headband, by an arm that extends behind the auricle of a user's ear, or by direct interaction with the concha of a user's ear. In the latter case, it can be challenging to balance secure support of the earpiece with comfort. For example, an earpiece that applies significant pressure to sensitive portions of the auricle of a user's ear may be too uncomfortable to be acceptable to some users, particularly if the earpiece is to be worn for long periods of time. On the other hand, if an earpiece is secured to a user's ear too loosely, the earpiece may be easily dislodged during normal use, which can also be unacceptable to some users.

Balancing secure mounting of an earpiece to the auricle of a user's ear with comfort is particularly difficult in the context of wireless earpieces. These earpieces are capable of receiving an audio signal and converting the audio signal into sound without the need for any wired connections. Instead of using wires, wireless earpieces may rely on Bluetooth or a similar wireless communication standard to receive an audio signal. Wireless earpieces tend to be larger and heavier than wired earpieces, and, therefore, tend to be more difficult to adequately secure to the auricle of a user's ear. Moreover, wireless earpieces are more likely than wired earpieces to be damaged or lost if inadvertently dislodged because, unlike wired earpieces, wireless earpieces are not physically tethered to other structures via wires. Accordingly, the need for secure support may be greater for wireless earpieces than it is for wired earpieces. For these and/or other reasons, there is a need for innovation related to forming a secure and comfortable connection between an earpiece and the auricle of a user's ear.

BRIEF DESCRIPTION OF THE DRAWINGS

Many aspects of the present technology can be better understood with reference to the following drawings. The components in the drawings are not necessarily to scale. Instead, emphasis is placed on illustrating clearly the principles of the present technology. For ease of reference, throughout this disclosure identical reference numbers may be used to identify identical, similar, or analogous components or features of more than one embodiment of the present technology.

DETAILED DESCRIPTION

Earpieces and related devices, systems, and methods in accordance with embodiments of the present technology can at least partially address one or more problems associated with conventional technologies whether or not such problems are stated herein. For example, earpieces in accordance with at least some embodiments of the present technology include innovative features for securely connecting to a user's ear without unduly compromising comfort. Furthermore, these and/or other features can facilitate convenient mounting of an earpiece to a user's ear, such as by reducing the manipulation necessary to move an earpiece from a fully unmounted state to a fully mounted state. For example, while some conventional earpieces require two district operations to move from a fully unmounted state to a fully mounted state, earpieces in accordance with at least some embodiments of the present technology are configured to move from a fully unmounted state to a fully mounted state in response to a single operation.

Specific details of earpieces and related devices, systems, and methods in accordance with several embodiments of the present technology are described herein with reference to FIGS. 1-16. Although earpieces and related devices, systems, and methods may be described herein primarily or entirely in the context of wireless dual-earpiece personal audio systems, other contexts in addition to those described herein are within the scope of the present technology. For example, suitable features of described wireless dual-earpiece personal audio systems can be implemented in the context of wired dual-earpiece personal audio systems, wireless single-earpiece personal audio systems, and wired single-earpiece personal audio systems, among other examples. Furthermore, it should understood, in general, that other devices, systems, and methods in addition to those disclosed herein are within the scope of the present technology. For example, devices, systems, and methods in accordance with embodiments of the present technology can have different and/or additional configurations, components, procedures, etc. than those disclosed herein. Moreover, a person of ordinary skill in the art will understand that devices, systems, and methods in accordance with embodiments of the present technology can be without one or more of the configurations, components, procedures, etc. disclosed herein without deviating from the present technology.

Figure 1:
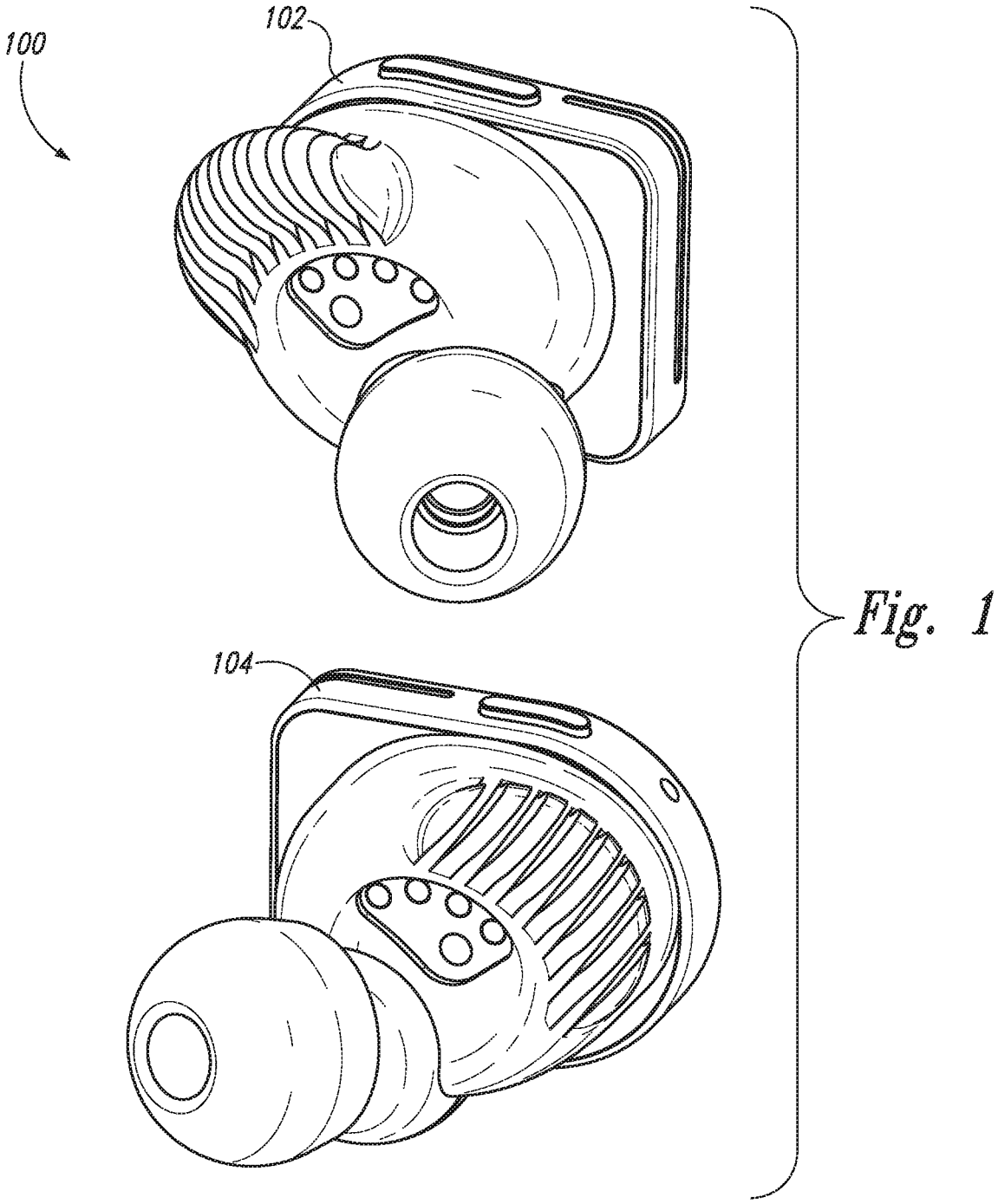
FIG. 1 is a perspective view of a left earpiece and a right earpiece of a personal audio system in accordance with at least some embodiments of the present technology.
Figure 3:
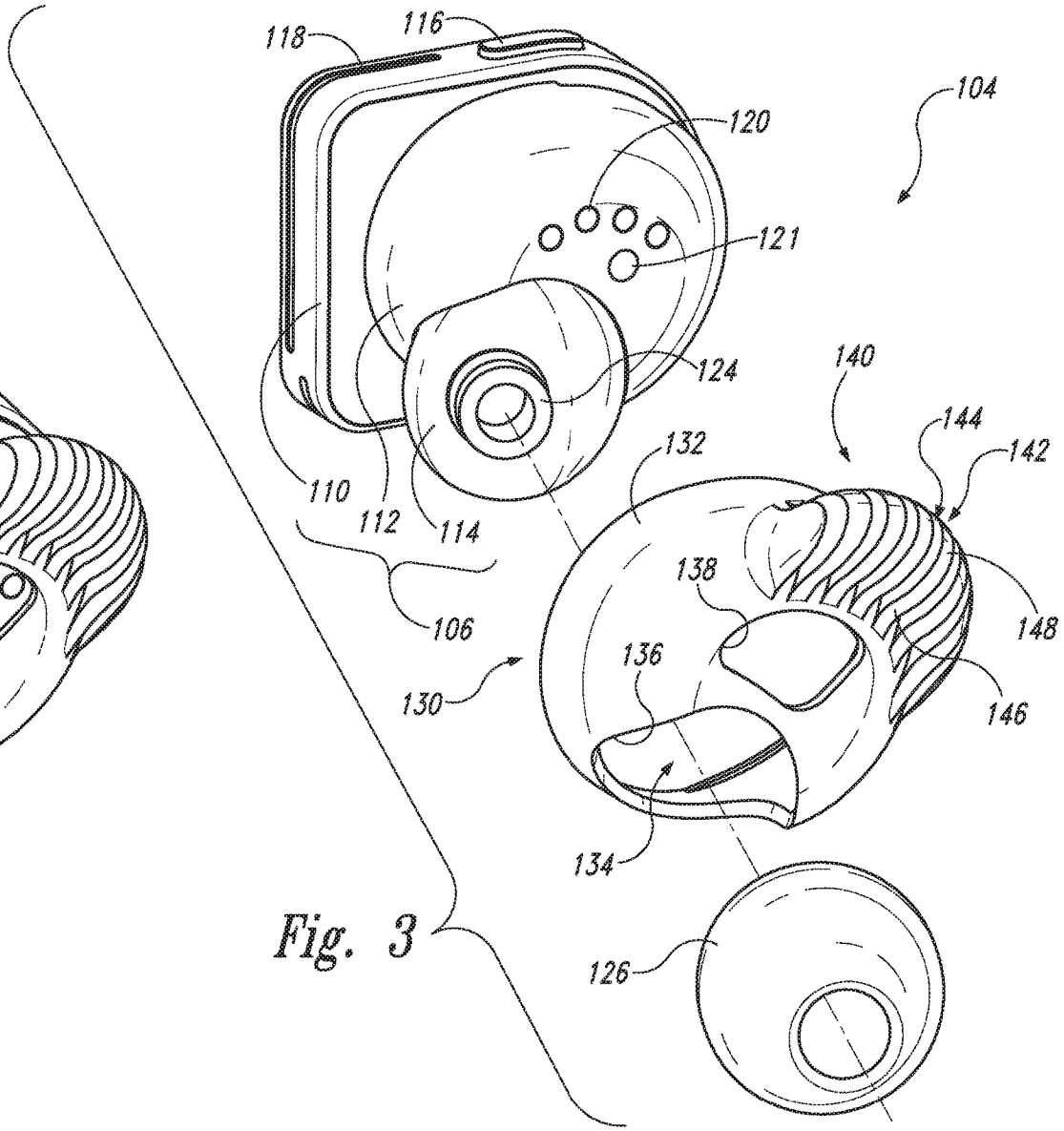
FIG. 3 is an exploded perspective view of the right earpiece shown in FIG. 1.
Figure 2:
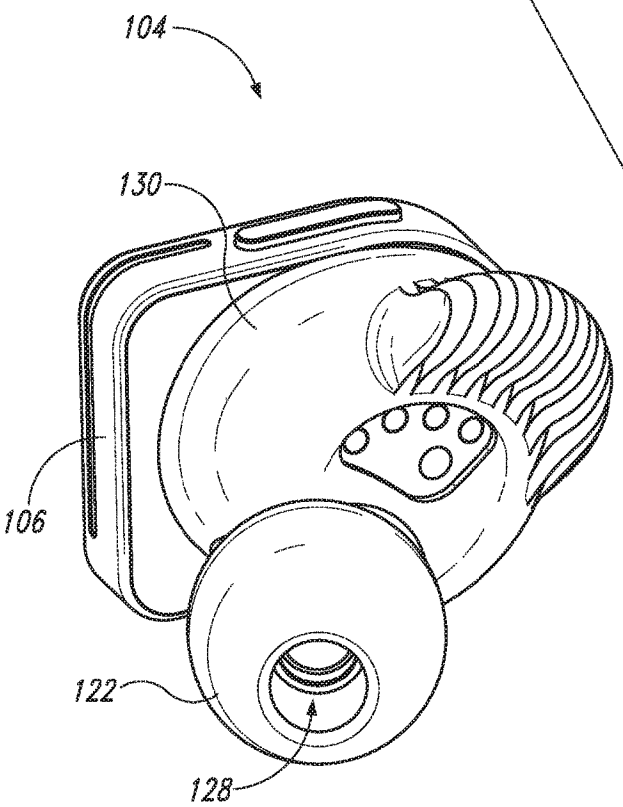
FIG. 2 is a perspective view of the right earpiece shown in FIG. 1.
Figure 4:
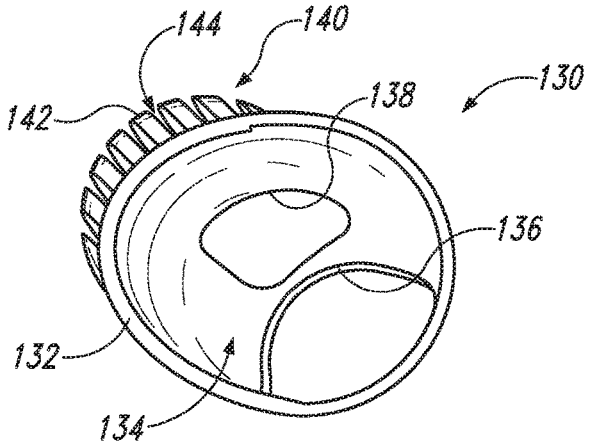
FIG. 4 is an inner side profile view of a stabilizer accessory of the right earpiece shown in FIG. 1.
Figure 5:
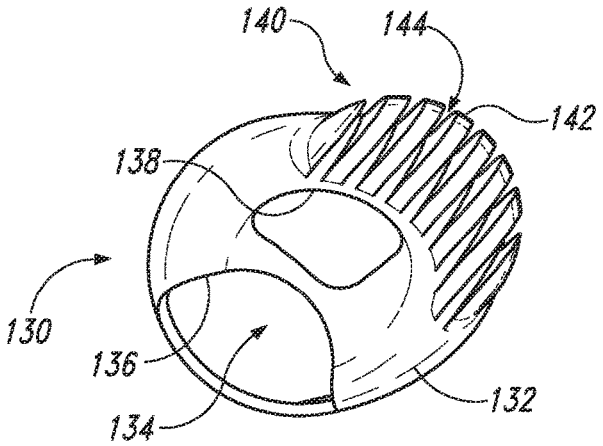
FIG. 5 is an outer side profile view of the stabilizer accessory of the right earpiece shown in FIG. 1.
Figure 6:
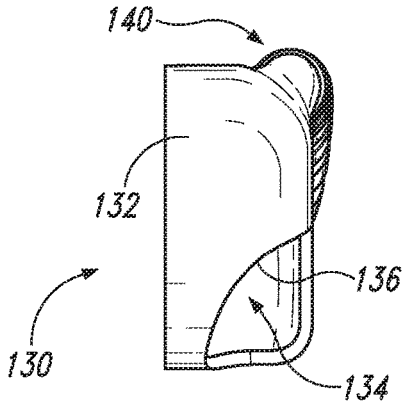
FIG. 6 is a front profile view of the stabilizer accessory of the right earpiece shown in FIG. 1.
Figure 7:
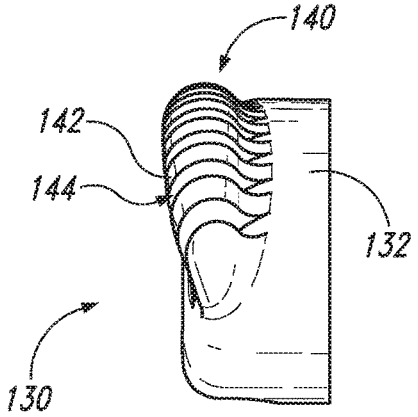
FIG. 7 is a rear profile view of a stabilizer accessory of the right earpiece shown in FIG. 1.
Figure 8:
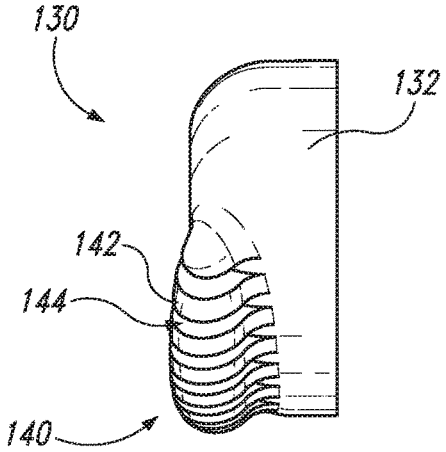
FIG. 8 is a top plan view of the stabilizer accessory of the right earpiece shown in FIG. 1.
Figure 9:
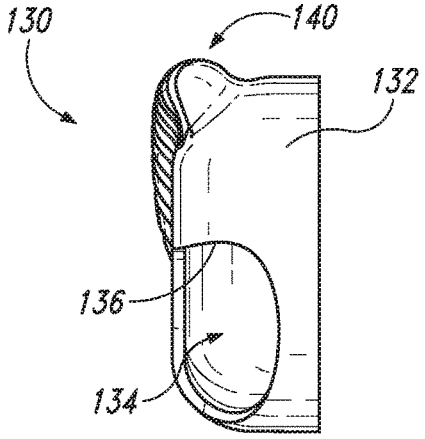
FIG. 9 is a bottom plan view of the stabilizer accessory of the right earpiece shown in FIG. 1.

FIG. 1 is a perspective view of a personal audio system 100 in accordance with at least some embodiments of the present technology. The personal audio system 100 can include a left earpiece 102 and a right earpiece 104 configured to be mounted to a user's left and right ears, respectively. Features of the personal audio system 100 will now be described primarily with reference to the right earpiece 104. It should be understood, however, that the left earpiece 102 can have the same or similar features. FIGS. 2 and 3 are, respectively, a perspective view and an exploded perspective view of the right earpiece 104. With reference to FIGS. 2 and 3 together, the right earpiece 104 can include a housing 106 and a speaker (not shown) within the housing 106. The housing 106 can have a first portion 110, a second portion 112, and a third portion 114 connected to one another in series. At the first portion 110 of the housing 106 or at another suitable location, the right earpiece 104 can include a button 116 and an antenna 118 operably connected to electronics (not shown) within the housing 106. At the second portion 112 of the housing 106, or at another suitable location, the right earpiece 104 can include charging pins 120 (one labeled) and a proximity sensor 121 operably connected to the electronics.

The second and third portions 112, 114 of the housing 106 can be positioned to be between the first portion 110 of the housing 106 and a user's head (not shown) when the right earpiece 104 is mounted to a user's ear (also not shown). In at least some cases, the first, second, and third portions 110, 112, 114 of the housing 106 have increasingly smaller perimeters parallel to the side of the user's head when the right earpiece 104 is mounted to the user's ear. Furthermore, the first, second, and third portions 110, 112, 114 of the housing 106 can be successively more rounded in form. For example, the first portion 110 of the housing 106 can be shaped as a rounded rectangular solid, the second portion 112 of the housing 106 can be shaped as an oblate spheroid segment, and the third portion 114 of the housing 106 can be shaped as a less oblate spheroid segment, as a spherical segment, or as a prolate spheroid segment. The first, second, and third portions 110, 112, 114 of the housing 106 can be integrally formed (e.g., co-molded) or separately formed and then assembled.

The right earpiece 104 can further include an earbud 122 carried by the housing 106. The earbud 122 can be positioned to extend outwardly from the housing 106 toward a canal of the user's ear when the right earpiece 104 is mounted to the user's ear. The earbud 122 can include a rigid stem 124 extending outwardly from the third portion 114 of the housing 106. The earbud 122 can also include a removable cushion 126 extending circumferentially around the stem 124. The cushion 126 can be shaped to be snugly received within the canal of the user's ear when the right earpiece 104 is mounted to the user's ear. In at least some cases, the cushion 126 is made up mostly or entirely out of a resilient material (e.g., silicone or rubber). The stem 124 and the cushion 126 can at least partially define a channel 128 through which sound travels from the speaker to an eardrum of the user's ear.

The right earpiece 104 can still further include a stabilizer accessory 130 carried by the housing 106. FIGS. 4-9 are different views of the stabilizer accessory 130 in isolation. With reference to FIGS. 2-9 together, the stabilizer accessory 130 can include a shell 132 defining a cavity 134 shaped to fit snugly around the second portion 112 of the housing 106. The stabilizer accessory 130 can also include a first window 136 and a second window 138 extending through the shell 132. The first window 136 can be positioned to allow the earbud 122 to extend from the cavity 134 toward the canal of the user's ear when the right earpiece 104 is mounted to the user's ear. The second window 138 can be positioned to align with the charging pins 120 and the proximity sensor 121. In at least some cases, the stabilizer accessory 130 is made up mostly or entirely out of a resilient material (e.g., silicone or rubber). In these and other cases, the stabilizer accessory 130 can be configured to resiliently deform (e.g., stretch) when placed on or removed from the housing 106. The stabilizer accessory 130 can be held in engagement with the housing 106 by friction. In addition or alternatively, the first, second, and/or third portions 110, 112, 114 of the housing 106 and/or the earbud 122 can be shaped to prevent the stabilizer accessory 130 from disengaging from the housing 106 without resiliently deforming in response to deliberate manipulation. For example, the second portion 112 of the housing 106 can include a groove (not shown) shaped to receive an inwardly projecting ridge (also not shown) of the shell 132.

The right earpiece 104 can also include a protrusion 140 that extends outwardly from the housing 106. In some embodiments, the protrusion 140 is part of the stabilizer accessory 130, and is removably connected to the housing 106 along with the shell 132. In other embodiments, the stabilizer accessory 130 can be eliminated and the protrusion can be permanently connected to the housing 106. With reference again to FIGS. 2-9, the protrusion 140 can include resilient members 142 (one labeled) and slots 144 (one labeled) intervening the resilient members 142. The individual resilient members 142 can have a proximal end portion 146 (one labeled) and an opposite distal end portion 148 (one labeled). The resilient members 142 can be hingedly connected to the shell 132 via their proximal end portions 146. In at least some cases, the resilient members 142 are made up mostly or entirely out of a resilient material (e.g., silicone or rubber). In these and other cases, the resilient members 142 and the shell 132 can be made of the same material. For example, the resilient members 142 and the shell 132 can be co-molded from the same resilient material. Alternatively, the resilient members 142 and the shell 132 can be made of different materials. For example, the material of the resilient members 142 can be softer than the material of the shell 132. The relative softness of the resilient members 142 can be useful to enhance comfort, and the relative stiffness of the shell 132 can be useful to enhance attachment of the stabilizer accessory 130 to the housing 106.

Figure 10:
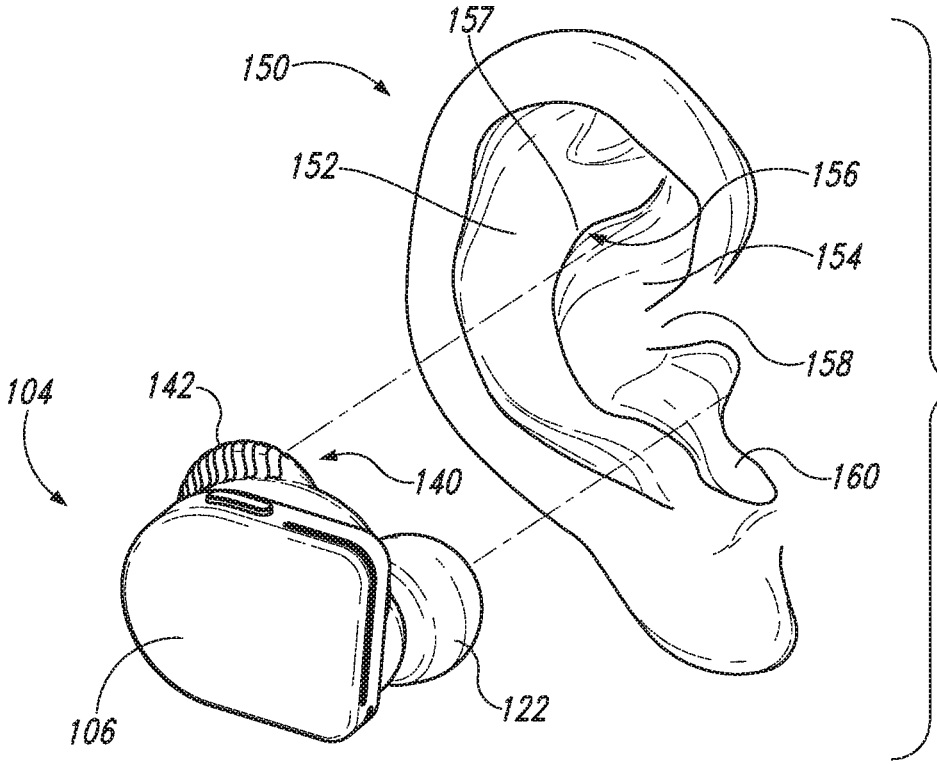
FIG. 10 is a perspective view of the right earpiece shown in FIG. 1 in a first position in which the right ear piece is proximate to, but not in contact with a user's ear.

FIG. 10 is a perspective view of the right earpiece 104 in a first position in which the right ear piece 104 is proximate to, but not in contact with a user's ear 150. As shown in FIG. 10, the user's ear 150 can include an antihelix 152 and a cymba concha 154 at least partially defining a recess 156 therebetween. The antihelix 152 can include an anterior ridge 157 extending over the cymba concha 154. For purposes of describing the present technology, the portion of the recess 156 defined by the anterior ridge 157 includes the ear tissue at the medial side of the anterior ridge 157. Also for purposes of describing the present technology, the portion of the recess 156 defined by the cymba concha 154 includes the ear tissue medially adjacent to the medial side of the anterior ridge 157. The user's ear 150 can also include a crus helix 158 inferior to the cymba concha 154, and a canal 160 also inferior to the cymba concha 154.

Figure 11:
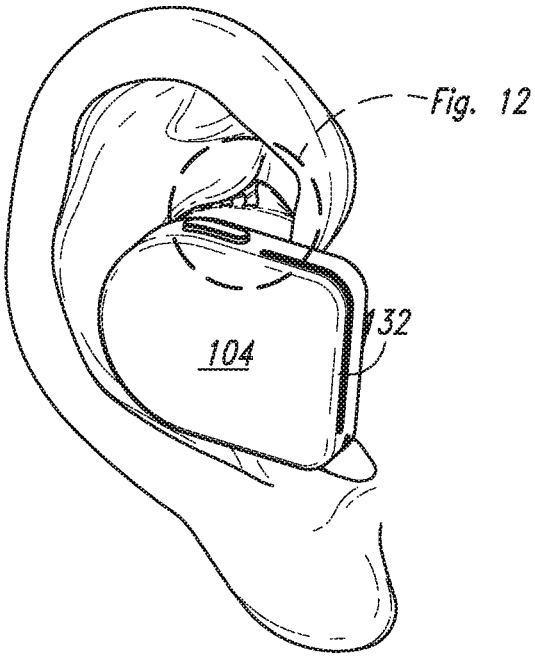
FIG. 11 is a perspective view of the right earpiece shown in FIG. 1 in a second position in which the right earpiece is fully mounted to and supported by the user's ear.

FIG. 11 is a perspective view of the right earpiece 104 in a second position in which the right earpiece 104 is fully mounted to and supported by the user's ear 150. With reference to FIGS. 10 and 11 together, the right earpiece 104 can be configured to be supported in the second position by a wedging effect of a first force exerted against the right earpiece 104 from the user's ear 150 via the earbud 122 and an opposing second force exerted against the right earpiece 104 from the user's ear 150 via the protrusion 140. In at least some cases, the protrusion 140 is positioned to be centered at an inferior half of the cymba concha 154 when the right earpiece 104 is mounted to the user's ear 150. In these and other cases, the right earpiece 104 can be configured to be out of contact with a superior half of the cymba concha 154 when the right earpiece 104 is mounted to the user's ear 150. Although the present technology is described with reference to the particular anatomy of the illustrated ear 150, it should be understood that various embodiments of the present technology are also compatible with other ear anatomies. For example, in some ears, the anterior ridge 157 does not overhang the inferior half of the cymba concha 154. In these cases, the wedging effect alone may be sufficient to stabilize a position of the protrusion 140 at the inferior half of the cymba concha 154.

The inventors have discovered that variation in the distance between a posteriormost portion of the inferior half of the cymba concha 154 and an anteriormost portion of the canal 160 is lower than variation in many other aspects of ear anatomy within the human population. The stabilizer accessory 130 can be configured to accommodate at least some of this relatively low variation by resiliently deforming. Furthermore, the stabilizer accessory 130 can be one of a set of stabilizer accessories configured to fit users with different ear anatomies. For example, another member of the set (not shown) can include counterparts of the resilient members 142 that extend a lesser or greater distance outwardly from a counterpart of the shell 132 relative to a distance by which the resilient members 142 of the stabilizer accessory 130 extend outwardly from the shell 132. A user can then use trial and error to select a stabilizer accessory from the set that provides a desired level of stability and/or comfort.

With reference again to FIGS. 10 and 11, the right earpiece 104 can be configured to move from being out of contact with the user's ear 150 in the first position to being fully mounted to the user's ear 150 in the second position in response to (e.g., solely in response to) unidirectional force exerted against the right earpiece 104 via the housing 106. For example, this unidirectional force can be pressure from a single fingertip pushing the right earpiece 104 directly toward the user's ear 150. Thus, the right earpiece 104 can be configured to fully mount in one step. In contrast to this one-step mounting, mounting a conventional earpiece to the user's ear 150 may involve first positioning an earbud of the conventional earpiece at the canal 160 and then separately positioning a secondary support element of the conventional earpiece at another portion of the user's ear 150. Between these steps, a user may need to adjust his or her grip on the conventional earpiece. This can be inconvenient for users, particularly when there is a need to mount and dismount the conventional earpiece frequently. It should be noted, however, that counterparts of the right earpiece 104 in accordance with some embodiments of the present technology are configured to be mounted in two or more steps.

Figure 12:
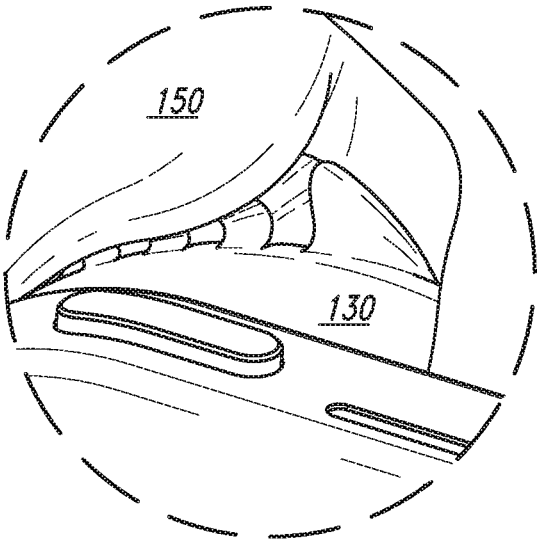
FIG. 12 is an enlarged perspective view of an interface between the stabilizer accessory of the right earpiece shown in FIG. 1 and the user's ear when the right earpiece is in the second position shown in FIG. 11.

FIG. 12 is an enlarged perspective view of an interface between the stabilizer accessory 130 and the user's ear 150 when the right earpiece 104 is in the second position shown in FIG. 11. With reference to FIGS. 10-12 together, the protrusion 140 can be positioned to be at least partially received within the recess 156 when the right earpiece 104 is mounted to the user's ear 150. For example, the resilient members 142 can be positioned to move into contact with the recess 156 as the right earpiece 104 moves from the first position toward the second position. The protrusion 140 can have a relaxed state when the right earpiece 104 is in the first position and a resiliently compressed state when the right earpiece 104 is in the second position. In at least some cases, the protrusion 140 is configured to move from the relaxed state toward the resiliently compressed state in response to pressure exerted against the protrusion 140 via a portion of the recess 156 defined by the cymba concha 154. In these and other cases, the distal end portions 148 (FIG. 3) of the individual resilient members 142 can be shaped to conformably engage the portion of the recess 156 defined by the cymba concha 154.

Furthermore, the protrusion 140 can be arcuate parallel to an adjacent length of the anterior ridge 157. This arcuate dimension of the protrusion can have a radius of curvature corresponding to a radius of curvature of the recess 156. Perpendicular to the adjacent length of the anterior ridge 157, the protrusion 140 can be arcuate with a smaller radius of curvature.

Figure 13:
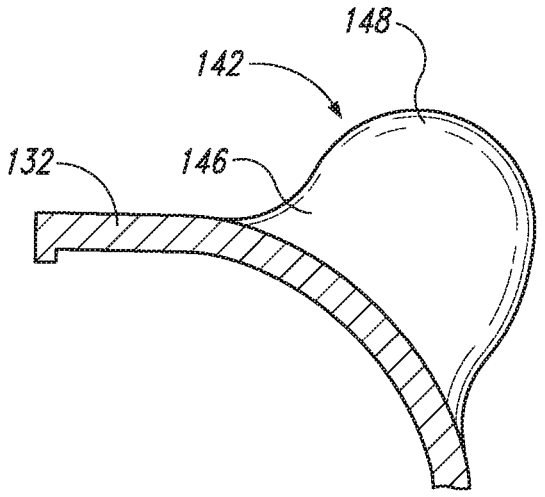
FIGS. 13 and 14 are, respectively, a front profile view and an outer side profile view of a single resilient member and associated structures of the stabilizer accessory of the right earpiece shown in FIG. 1 when the right earpiece is in the first position shown in FIG. 10.
Figure 14:
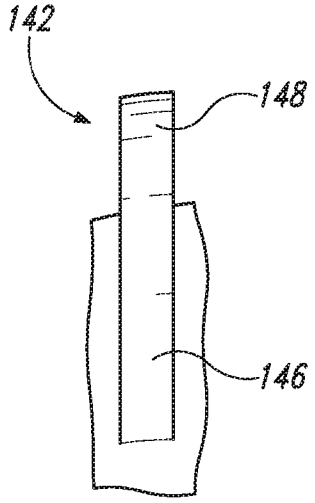
Figure 15:
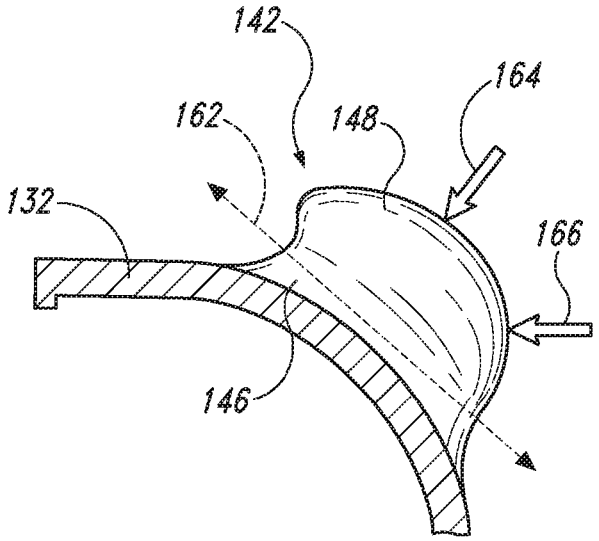
FIGS. 15 and 16 are, respectively, a front profile view and an outer side profile view of the single resilient member and associated structures of the stabilizer accessory of the right earpiece shown in FIG. 1 when the right earpiece is in the second position shown in FIG. 11.
Figure 16:
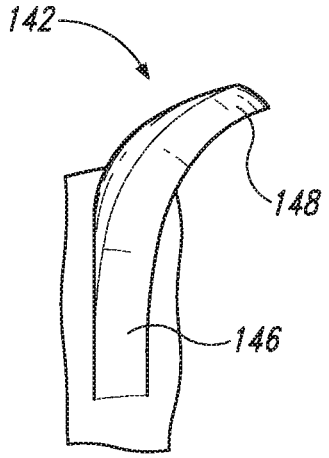

FIGS. 13 and 14 are, respectively, a front profile view and an outer side profile view of a single resilient member 142 and associated structures of the stabilizer accessory 130 when the right earpiece 104 is in the first position shown in FIG. 10. FIGS. 15 and 16 are, respectively, a front profile view and an outer side profile view of the single resilient member 142 and associated structures of the stabilizer accessory 130 when the right earpiece 104 is in the second position shown in FIG. 11. With reference to FIGS. 10-16 together, the individual resilient members 142 can be configured to preferentially bend relative to the housing 106 in a direction parallel to an adjacent length of the anterior ridge 157 when the right earpiece 104 is mounted to the user's ear 150. This bending can occur along bending axes 162 (FIG. 15) tangential to the proximal end portions 146 of the individual resilient members 142. In addition, the individual resilient members 142 can be configured to at least partially collapse against one another when the right earpiece 104 is mounted to the user's ear 150. For example, the resilient members 142 can be spaced apart from one another when the protrusion 140 is in the relaxed state and in contact with one another when the protrusion 140 is in the resiliently compressed state. The individual resilient members 142 can bend to different degrees depending on the anatomy of the user's ear 150, such as the distance between the canal 160 and the recess 156. When this distance is relatively small, the individual resilient members 142 can fully collapse against one another. When this distance is relatively large, the individual resilient members 142 can partially collapse and remain spaced apart from one another.

The protrusion 140 can be shaped and/or otherwise configured to enhance both comfort and stability. The protrusion 140 can have a first degree of resistance to deforming in response to a given pressure when the given pressure is exerted against the protrusion 140 via a portion of the recess 156 defined by the cymba concha 154 ("cymba concha pressure"). The protrusion 140 can have a second degree of resistance to deforming in response to the given pressure when the given pressure is exerted against the protrusion 140 via a portion of the recess 156 defined by the anterior ridge 157 ("antihelix pressure"). In FIG. 15, the cymba concha pressure and the antihelix pressure are represented by arrows 164 and 166, respectively. The second degree of resistance can be greater than the first degree of resistance, such as at least two, three, or four times greater. When the right earpiece 104 is in the second position, the cymba concha pressure can be a sustained pressure that tends to hold the right earpiece 104 in place. In contrast, the antihelix pressure can be a brief pressure that tends to displace the right earpiece 104. Accordingly, the relatively low rigidity of the protrusion 140 in response to the cymba concha pressure can promote comfort, and the relatively high rigidity of the protrusion 140 in response to the antihelix pressure can promote stability.

The orientation, width, and shape of the individual slots 144 (FIG. 3) and resilient members 142 can be selected to change the manner in which the protrusion 140 deforms in response to the cymba concha pressure and the antihelix pressure. For example, the bending axes 162 of individual resilient members 142 can be approximately perpendicular (e.g., at most 30 degrees off perpendicular) relative to an adjacent length of the anterior ridge 157 when the right earpiece 104 is in the second position shown in FIG. 11. As shown in FIG. 15, the bending axes 162 can also be approximately perpendicular (e.g., at most 30 degrees off perpendicular) relative to the cymba concha pressure (arrow 164). Furthermore, the minimum angle between the bending axes 162 and the cymba concha pressure can be greater than the minimum angle between the bending axes 162 and the antihelix pressure (arrow 166). This angle difference can correspond to the difference between the first and second degrees of resistance. In at least some cases, the angle difference remains approximately the same (e.g., +/−10%) regardless of extent to which the resilient members 142 are bent at any given time. Thus, the difference between the first and second degrees of resistance can also remain approximately the same regardless of the particular anatomy of the user's ear 150.

In some embodiments, the resilient members 142 are flaps. In other embodiments, counterparts of the resilient members 142 can have other suitable forms. For example, counterparts of the resilient members 142 can be fins, ribs, or bumps. Furthermore, counterparts of the protrusion 140 can be monolithic or appear monolithic. For example, a counterpart of the protrusion 140 can include relatively low density material in counterparts of the slots 144 and/or a skin covering counterparts of the resilient members 142. Other variations of the resilient members 142 and the protrusion 140 are also possible within the scope of the present technology.

This disclosure is not intended to be exhaustive or to limit the present technology to the precise forms disclosed herein. Although specific embodiments are disclosed herein for illustrative purposes, various equivalent modifications are possible without deviating from the present technology, as those of ordinary skill in the relevant art will recognize. In some cases, well-known structures and functions have not been shown and/or described in detail to avoid unnecessarily obscuring the description of the embodiments of the present technology. Although steps of methods may be presented herein in a particular order, in alternative embodiments the steps may have another suitable order. Similarly, certain aspects of the present technology disclosed in the context of particular embodiments can be combined or eliminated in other embodiments. Furthermore, while advantages associated with certain embodiments may have been disclosed in the context of those embodiments, other embodiments may also exhibit such advantages, and not all embodiments need necessarily exhibit such advantages or other advantages disclosed herein to fall within the scope of the present technology.

Throughout this disclosure, the singular terms "a," "an," and "the" include plural referents unless the context clearly indicates otherwise. Similarly, unless the word "or" is expressly limited to mean only a single item exclusive from the other items in reference to a list of two or more items, then the use of "or" in such a list is to be interpreted as including (a) any single item in the list, (b) all of the items in the list, or (c) any combination of the items in the list. Additionally, the terms "comprising" and the like may be used herein to mean including at least the recited feature(s) such that any greater number of the same feature(s) and/or one or more additional types of features are not precluded. Directional terms, such as "upper," "lower," "front," "back," "vertical," and "horizontal," may be used herein to express and clarify the relationship between various elements. It should be understood that such terms do not denote absolute orientation. Reference herein to "one embodiment," "an embodiment," or similar formulations means that a particular feature, structure, operation, or characteristic described in connection with the embodiment can be included in at least one embodiment of the present technology. Thus, the appearances of such phrases or formulations herein are not necessarily all referring to the same embodiment. Furthermore, various particular features, structures, operations, or characteristics may be combined in any suitable manner in one or more embodiments of the present technology.

We claim:

1. An earpiece configured to be mounted to a user's ear, the earpiece comprising:

a housing;

a speaker within the housing;

an earbud carried by the housing, wherein the earbud is positioned to extend from the housing toward a canal of the user's ear when the earpiece is mounted to the user's ear; and a protrusion positioned to be at least partially received within a recess at least partially defined by a cymba concha of the user's ear and by an anterior ridge of an antihelix of the user's ear when the earpiece is mounted to the user's ear, wherein the protrusion has a first degree of resistance to deforming in response to a given pressure when the given pressure is exerted against the protrusion via a portion of the recess defined by the cymba concha, and wherein the protrusion has a greater second degree of resistance to deforming in response to the given pressure when the given pressure is exerted against the protrusion via a portion of the recess defined by the anterior ridge.

2. The earpiece of claim 1 wherein:

the protrusion is arcuate with a first radius of curvature parallel to an adjacent length of the anterior ridge; and the protrusion is arcuate with a smaller second radius of curvature perpendicular to the adjacent length of the anterior ridge.

3. The earpiece of claim 1 wherein the earpiece is configured to move from a first position in which the earpiece is out of contact with the user's ear to a second position in which the earpiece is fully mounted to the user's ear in response to unidirectional force exerted against the earpiece via the housing.

4. The earpiece of claim 1 wherein the protrusion includes resilient members and slots intervening the resilient members.

5. The earpiece of claim 4 wherein the individual resilient members are configured to preferentially bend relative to the housing in a direction parallel to an adjacent length of the anterior ridge when the earpiece is mounted to the user's ear.

6. The earpiece of claim 4 wherein the individual resilient members have:

a proximal end portion at which the resilient member is hingedly connected to the housing; and a distal end portion shaped to conformably engage the portion of the recess defined by the cymba concha.

7. The earpiece of claim 4 wherein the resilient members are flaps.

8. The earpiece of claim 1 wherein:

the protrusion has a relaxed state and a resiliently compressed state; and the protrusion is configured to move from the relaxed state toward the resiliently compressed state in response to pressure exerted against the protrusion via the portion of the recess defined by the cymba concha.

9. The earpiece of claim 8 wherein the protrusion includes flaps spaced apart from one another when the protrusion is in the relaxed state and in contact with one another when the protrusion is in the resiliently compressed state.

10. The earpiece of claim 1 wherein the protrusion is part of a stabilizer accessory removably connected to the housing.

11. A stabilizer accessory configured to be removably couplable with an earpiece and mounted to a user's ear to stabilize the earpiece, the stabilizer accessory comprising:

a shell defining a cavity;

a window extending through the shell, wherein the window is positioned to allow an earbud of the earpiece to extend from the cavity toward a canal of the user's ear when the stabilizer accessory is mounted to the user's ear; and resilient members hingedly connected to the shell, wherein the resilient members are configured to bend relative to the shell along respective bending axes when the stabilizer accessory is mounted to the user's ear, and wherein the bending axes are at most 30 degrees off perpendicular relative to an adjacent length of an anterior ridge of an antihelix of the user's ear when the stabilizer accessory is mounted to the user's ear;

wherein the stabilizer accessory is removably couplable to the earpiece.

12. The stabilizer accessory of claim 11 wherein the resilient members are configured to at least partially collapse against one another when the stabilizer accessory is mounted to the user's ear.

13. The stabilizer accessory of claim 11 wherein the resilient members are positioned to contact a recess at least partially defined by a cymba concha of the user's ear and by the anterior ridge of the user's ear when the stabilizer accessory is mounted to the user's ear.

14. The stabilizer accessory of claim 11 wherein the resilient members are flaps.

* * * * *